US012013168B2

(12) United States Patent
Lee et al.

(10) Patent No.: US 12,013,168 B2
(45) Date of Patent: Jun. 18, 2024

(54) REFRIGERATOR AND METHOD FOR CONTROLLING SAME

(71) Applicant: LG ELECTRONICS INC., Seoul (KR)

(72) Inventors: Donghoon Lee, Seoul (KR); Donghoon Lee, Seoul (KR); Wookyong Lee, Seoul (KR); Seungseob Yeom, Seoul (KR); Yongjun Bae, Seoul (KR); Sunggyun Son, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/281,749

(22) PCT Filed: Oct. 1, 2019

(86) PCT No.: PCT/KR2019/012850

§ 371 (c)(1),
(2) Date: Mar. 31, 2021

(87) PCT Pub. No.: WO2020/071740

PCT Pub. Date: Apr. 9, 2020

(65) Prior Publication Data

US 2021/0396441 A1 Dec. 23, 2021

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 5/08* (2006.01)
*F25C 1/18* (2006.01)
(Continued)

(52) U.S. Cl.
CPC ..... *F25C 5/08* (2013.01); *F25C 1/24* (2013.01); *F25C 1/25* (2018.01); *F25D 29/00* (2013.01);
(Continued)

(58) Field of Classification Search
CPC .... F25C 1/18; F25C 2400/14; F25C 2700/04; F25C 2700/12; F25C 2600/02; F25C 2600/04
See application file for complete search history.

(56) References Cited

U.S. PATENT DOCUMENTS 4,910,974 A * 3/1990 Hara ..... F25C 1/045 62/352
9,234,688 B2 1/2016 Son et al.
(Continued)

FOREIGN PATENT DOCUMENTS

CN 102878743 1/2013
CN 203100339 7/2013
(Continued)

OTHER PUBLICATIONS

Translated_Sakamoto (Year: 2006).*
(Continued)

*Primary Examiner* — Elizabeth J Martin
*Assistant Examiner* — Samba Gaye
(74) *Attorney, Agent, or Firm* — KED & Associates LLP

(57) ABSTRACT

A refrigerator includes: a storage chamber in which food is stored; a cold air supply means for supplying cold air to the storage chamber; a tray forming an ice-making cell; a heater for supplying heat to the tray; and a controller for controlling the heater. The controller turns on the heater in at least a part of a range in which the cold air supply means supplies cold air such that air bubbles dissolved in water inside the ice-making cell can move from ice-generating parts to
(Continued)

liquid-state water, thereby generating transparent ice. The controller determines whether or not the heater is functioning abnormally in the ice-making process. If it is determined that the heater is functioning abnormally, the controller supplies water to the ice-making cell by a second amount of water supply, which is smaller than the first amount of water supply, during the next water supply process.

9 Claims, 13 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081745 |

(51) Int. Cl.
*F25C 1/24* (2018.01)
*F25C 1/25* (2018.01)
*F25D 29/00* (2006.01)

(52) U.S. Cl.
CPC ..... *F25C 1/18* (2013.01); *F25C 2400/06* (2013.01); *F25C 2400/10* (2013.01); *F25C 2400/14* (2013.01); *F25C 2600/04* (2013.01); *F25C 2700/12* (2013.01)

(56) References Cited

U.S. PATENT DOCUMENTS

| | | | | |
|---|---|---|---|---|
| 10,054,358 | B2 | 8/2018 | Park et al. | |
| 2004/0025527 | A1* | 2/2004 | Takahashi | F25C 5/08 62/340 |
| 2010/0218520 | A1 | 9/2010 | McCollough et al. | |
| 2013/0014535 | A1 | 1/2013 | Son et al. | |
| 2013/0014536 | A1* | 1/2013 | Son | F25C 1/25 62/340 |
| 2013/0081412 | A1 | 4/2013 | Son et al. | |
| 2014/0165598 | A1* | 6/2014 | Boarman | F25C 1/22 62/347 |
| 2014/0182325 | A1 | 7/2014 | Lee et al. | |
| 2016/0370085 | A1 | 12/2016 | Kim | |
| 2017/0299244 | A1 | 10/2017 | Alshourbagy et al. | |
| 2018/0187941 | A1 | 7/2018 | An et al. | |
| 2018/0231294 | A1 | 8/2018 | Song et al. | |
| 2019/0219317 | A1* | 7/2019 | Yoon | F25C 1/18 |

FOREIGN PATENT DOCUMENTS

| | | | | |
|---|---|---|---|---|
| EP | 2687795 | A1 * | 1/2014 | F25C 5/005 |
| EP | 3059526 | | 8/2016 | |
| JP | H 04-124571 | A | 4/1992 | |
| JP | H05-203299 | | 8/1993 | |
| JP | H05-203302 | | 8/1993 | |
| JP | H0819734 | A * | 7/1994 | |
| JP | H06-070543 | | 9/1994 | |
| JP | H06-323705 | | 11/1994 | |
| JP | H 09-269172 | A | 10/1997 | |
| JP | 2003-114072 | | 4/2003 | |
| JP | 2003-232587 | A | 8/2003 | |
| JP | 2004-347310 | A | 12/2004 | |
| JP | 2005326035 | | 11/2005 | |
| JP | 2006275510 | A * | 10/2006 | |
| JP | 4572833 | | 11/2010 | |
| JP | 2011-064371 | | 3/2011 | |
| JP | 2011064373 | | 3/2011 | |
| JP | 2011-185541 | A | 9/2011 | |
| JP | 2011-237077 | | 11/2011 | |
| JP | 2013-032878 | A | 2/2013 | |
| JP | 2013-181734 | A | 9/2013 | |
| JP | 2013181734 | A * | 9/2013 | |
| JP | 10-1850918 | B1 | 5/2018 | |
| KR | 10-2005-0069319 | | 7/2005 | |
| KR | 10-2005-0096336 | | 10/2005 | |
| KR | 10-00610296 | | 8/2006 | |
| KR | 2006124338 | A * | 12/2006 | F25C 5/02 |
| KR | 10-00781261 | B1 | 11/2007 | |
| KR | 10-2009-0079377 | | 7/2009 | |
| KR | 10-0924365 | | 10/2009 | |
| KR | 10-2012-0003233 | | 1/2012 | |
| KR | 10-2013-0009322 | | 1/2013 | |
| KR | 10-2013-0009332 | | 1/2013 | |
| KR | 2013-0009521 | A | 1/2013 | |
| KR | 20130009332 | | 1/2013 | |
| KR | 10-2014-0088321 | | 7/2014 | |
| KR | 10-1643635 | | 7/2016 | |
| KR | 2018-080021 | A | 7/2018 | |
| KR | 10-2018-0100752 | | 9/2018 | |
| WO | WO-03016796 | A1 * | 2/2003 | F25C 1/04 |

OTHER PUBLICATIONS

Translated_Chang (Year: 2006).*
Translated_nakamoto (Year: 1994).*
Translated_Katsuya (Year: 2013).*
International Search Report dated Jan. 16, 2020 issued in Application No. PCT/KR2019/012850.
Chinese Office Action dated May 25, 2022 issued in CN Application No. 201980065212.9.
Indian Office Action dated Jan. 27, 2022 issued in IN Application No. 202117018061.
Korean Office Action dated May 1, 2023 issued in Application No. 10-2018-0117785.
Korean Office Action dated May 8, 2023 issued in Application No. 10-2018-0117819.
Korean Office Action dated May 14, 2023 issued in Application No. 10-2018-0117821.
Korean Office Action dated May 15, 2023 issued in Application No. 10-2018-0117822.
Korean Office Action dated Jul. 4, 2023 issued in Application 10-2018-0142117.
Korean Notice of Allowance dated Jan. 10, 2024 issued in Application No. 10-2018-0142117.
Korean Office Action dated Mar. 12, 2024, issued in Application No. 10-2018-0117822.

* cited by examiner

REFRIGERATOR AND METHOD FOR CONTROLLING SAME

CROSS-REFERENCE TO RELATED PATENT APPLICATIONS

This application is a U.S. National Stage Application under 35 U.S.C. § 371 of PCT Application No. PCT/KR2019/012850, filed Oct. 1, 2019, which claims priority to Korean Patent Application Nos. 10-2018-0117785, filed Oct. 2, 2018, 10-2018-0117819, filed Oct. 2, 2018, 10-2018-0117821, filed Oct. 2, 2018, 10-2018-0117822, filed Oct. 2, 2018, 10-2018-0142117, filed Nov. 16, 2018, and 10-2019-0081745, filed Jul. 6, 2019, whose entire disclosures are hereby incorporated by reference.

TECHNICAL FIELD

The present disclosure relates to a refrigerator and a method for controlling the same.

BACKGROUND ART

In general, refrigerators are home appliances for storing foods at a low temperature in a storage chamber that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray.

The ice maker may separate the made ice from the ice tray in a heating manner or twisting manner.

For example, the ice maker through which water is automatically supplied and the ice automatically separated may be opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 (hereinafter, referred to as a "prior art document 1") that is a prior art document.

The ice maker disclosed in the prior art document 1 includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the prior art document 1, although the spherical ice is made by the hemispherical upper cell and the hemispherical lower cell, since the ice is made at the same time in the upper and lower cells, bubbles containing water are not completely discharged but are dispersed in the water to make opaque ice.

An ice maker is disclosed in Japanese Patent Laid-Open No. 9-269172 (hereinafter, referred to as a "prior art document 2") that is a prior art document.

The ice maker disclosed in the prior art document 2 includes an ice making plate and a heater for heating a lower portion of water supplied to the ice making plate.

In the case of the ice maker disclosed in the prior art document 2, water on one surface and a bottom surface of an ice making block is heated by the heater in an ice making process. Thus, when solidification proceeds on the surface of the water, and also, convection occurs in the water to make transparent ice.

When growth of the transparent ice proceeds to reduce a volume of the water within the ice making block, the solidification rate is gradually increased, and thus, sufficient convection suitable for the solidification rate may not occur.

Thus, in the case of the prior art document 2, when about ⅔ of water is solidified, a heating amount of the heater increases to suppress an increase in the solidification rate.

However, according to prior art document 2, since the heating amount of the heater is increased simply when the volume of water is reduced, it is difficult to make ice having uniform transparency according to the shape of the ice.

DISCLOSURE

Technical Problem

Embodiments provide a refrigerator capable of making ice having uniform transparency as a whole regardless of shape, and a method for controlling the same.

Embodiments provide a refrigerator capable of making spherical ice and having uniform transparency for each unit height of the spherical ice, and a method for controlling the same.

Embodiments provide a refrigerator capable of making ice having uniform transparency as a whole by varying a heating amount of a transparent ice heater and/or cooling power of a cold air supply part in response to the change in the heat transfer amount between water in an ice making cell and cold air in a storage chamber, and a method for controlling the same.

Embodiments provide a refrigerator in which, when a transparent ice heater is detected as not operating normally, a water supply amount is adjusted considering volume expansion of water, so that ice is smoothly separated after ice making is completed, and a method for controlling the same.

Embodiments provide a refrigerator capable of preventing water from existing at a central portion of ice even when an ice making rate is increased because a transparent ice heater does not operate normally, and a method for controlling the same.

Technical Solution

According to one aspect, after water is supplied to an ice making cell as much as a first water supply amount, a controller controls a heater to be turned on in at least partial section while a cold air supply part supplies cold air so that bubbles dissolved in the water within the ice making cell moves from a portion, at which the ice is made, toward the water that is in a liquid state to make transparent ice.

The controller may determine whether the heater operates abnormally during an ice making process, and when the controller determines that the heater operates abnormally, the controller may control water supply so that the water is supplied to the ice making cell as much as a second water supply amount smaller than the first water supply amount in a next water supply process.

According to this embodiment, the controller may determine whether the heater operates abnormally, based on an elapsed time having elapsed from the start of ice making until a temperature sensed by a temperature sensor configured to sense a temperature of water or ice in the ice making cell reaches a first reference temperature.

When the elapsed time having elapsed from the start of the ice making until the temperature sensed by the temperature sensor reaches the first reference temperature is longer than a set time, the controller may determine that the heater operates normally.

When the elapsed time having elapsed from the start of the ice making until the temperature sensed by the temperature sensor reaches the first reference temperature is shorter than the set time, the controller may determine that the heater operates abnormally.

When the elapsed time is shorter than the set time, the controller may perform ice separation after waiting for the ice separation until a waiting time after a time point when the temperature sensed by the temperature sensor reaches the first reference temperature reaches a waiting reference time.

According to this embodiment, the ice making cell may be defined by a first tray and a second tray. The first tray may define a portion of the ice making cell, which is a space in which water is phase-changed into ice by the cold air, and the second tray may define another portion of the ice making cell. The second tray may contact the first tray in the ice making process and may be spaced apart from the first tray in an ice separation process. The second tray may be connected to a driver to receive power from the driver.

Due to the operation of the driver, the second tray may move from a water supply position to an ice making position. Also, due to the operation of the driver, the second tray may move from the ice making position to an ice separation position. The water supply of the ice making cell may start when the second tray moves to the water supply position.

After the water supply is completed, the second tray may be moved to the ice making position. After the second tray moves to the ice making position, the cold air supply part may supply the cold air to the ice making cell. When the ice is completely made in the ice making cell, the second tray moves to the ice separation position in a forward direction so as to take out the ice in the ice making cell. After the second tray moves to the ice separation position, the second tray may move to the water supply position in the reverse direction, and the water supply may start again.

When it is determined that the heater operates abnormally, water is supplied to the ice making cell as much as the second water supply amount for the next ice making. The second tray may move to the ice making position, and the cold air supply part may supply the cold air to the ice making cell.

When the temperature sensed by the temperature sensor reaches a first reference temperature after the start of the ice making, the controller may determine that the ice making is completed.

When the controller determines that the ice making has been completed, the controller may determine whether an ice making time has passed a completion reference time. When the ice making time has not passed the completion reference time, the controller may perform ice separation after waiting for the ice separation until the ice making time has passed the completion reference time.

The controller may control one or more of the cooling power of the cold air supply part and the heating amount of the heater to vary according to a mass per unit height of water in the ice making cell.

According to another aspect, a refrigerator may include a controller configured to recognize the selection of one of a transparent ice mode and a quick ice making mode.

When the transparent ice mode is selected, the controller may control water supply so that water is supplied to an ice making cell as much as a first water supply amount in a water supply process. On the other hand, when the quick ice making mode is selected, the controller may control water supply so that water is supplied to the ice making cell as much as a second water supply amount smaller than the first water supply in the water supply process.

In the transparent ice mode, the controller may control the heater to be turned on in at least partial section while the cold air supply part supplies cold air so that bubbles dissolved in the water within the ice making cell moves from a portion, at which the ice is made, toward the water that is in a liquid state to make transparent ice.

The controller may control one or more of the cooling power of the cold air supply part and the heating amount of the heater to vary according to a mass per unit height of water in the ice making cell.

In the transparent ice mode, the controller may determine that the heater operates normally. When the controller determines that the heater operates abnormally, the controller may control water supply so that water is supplied to the ice making cell as much as the second water supply amount in the next water supply process.

In the quick ice making mode, the controller may turn off the heater.

In the quick ice making mode, when the temperature sensed by the second temperature sensor reaches a first reference temperature after the start of the ice making, the controller may determine that the ice making is completed. When the controller determines that the ice making has been completed, the controller may determine whether an ice making time has passed a completion reference time.

When the ice making time has not passed the completion reference time, the controller may perform ice separation after waiting for the ice separation until the ice making time has passed the completion reference time.

According to further another aspect, a method for controlling a refrigerator relates to a method for controlling a refrigerator that includes a first tray accommodated in a storage chamber, a second tray configured to define an ice making cell together with the first tray, and a heater configured to supply heat to at least one of the first tray and the second tray.

The method for controlling the refrigerator may include: performing water supply of the ice making cell as much as a first water supply amount when the second tray moves to a water supply position; performing ice making by supplying cold air to the ice making cell after the water supply is completed and the second tray moves from the water supply position to an ice making position in a reverse direction; determining whether ice making is completed; and when the ice making is completed, moving the second tray from the ice making position to an ice separation position in a forward direction.

The controller may turn on the heater in at least partial section while the ice making is performed, so that bubbles dissolved in the water within the ice making cell moves from a portion, at which the ice is made, toward the water that is in a liquid state to make transparent ice.

The controller may determine that the heater operates abnormally in a state in which the heater is turned on.

When the controller determines that the heater operates abnormally, the controller may control water supply so that water is supplied to the ice making cell as much as a second water supply amount smaller than the first water supply amount in the next water supply process.

The controller may determine whether the heater operates abnormally, based on an elapsed time having elapsed from the start of ice making until a temperature sensed by a temperature sensor configured to sense a temperature of the ice making cell reaches a first reference temperature.

When the elapsed time having elapsed from the start of the ice making until the temperature sensed by the temperature sensor reaches the first reference temperature is longer than a set time, the controller may determine that the heater operates normally. On the other hand, when the elapsed time is shorter than the set time, the controller may determine that the heater operates abnormally.

When the elapsed time is shorter than the set time, the controller may perform ice separation after waiting for the ice separation until a waiting time after a time point when the temperature sensed by the temperature sensor reaches the first reference temperature reaches a waiting reference time.

Advantageous Effects

According to embodiments, since the heater is turned on in at least partial section while the cold air supply part supplies cold air, an ice making rate may decrease by the heat of the heater so that the bubbles dissolved in the water inside the ice making cell move toward the liquid water from the portion at which the ice is made, thereby making the transparent ice.

In particular, according to the embodiments, one or more of the cooling power of the cold air supply part and the heating amount of the heater may be controlled to vary according to the mass per unit height of water in the ice making cell to make the ice having the uniform transparency as a whole regardless of the shape of the ice making cell.

Also, the heating amount of the transparent ice heater and/or the cooling power of the cold air supply part may vary in response to the change in the heat transfer amount between the water in the ice making cell and the cold air in the storage chamber, thereby making the ice having the uniform transparency as a whole.

In addition, even if the transparent ice heater operates abnormally, it is possible to make ice in a spherical shape or a shape close to a sphere by adjusting the water supply amount.

In addition, there is an advantage in that ice is prevented from being separated in a state in which water exists after the ice making is completed.

MODE FOR INVENTION

Figure 1:
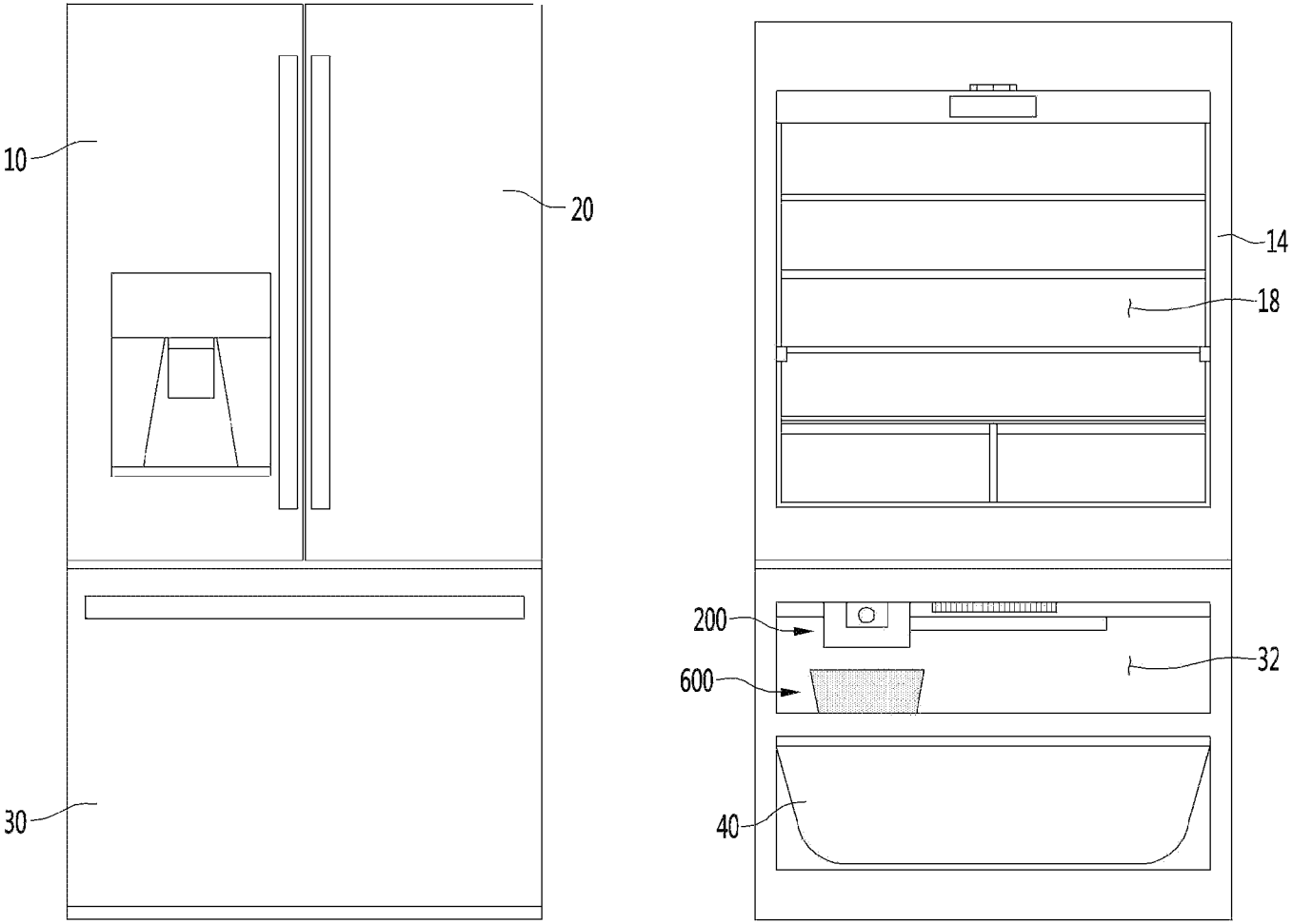
FIG. 1 is a front view of a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 18 is disposed at an upper side, and the freezing compartment 32 is disposed at a lower side. Each of the storage chambers may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner. The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 falls to be stored may be disposed below the ice maker 200. A user may take out the ice bin 600 from the freezing compartment 32 to use the ice stored in the ice bin 600. The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

Figure 2:
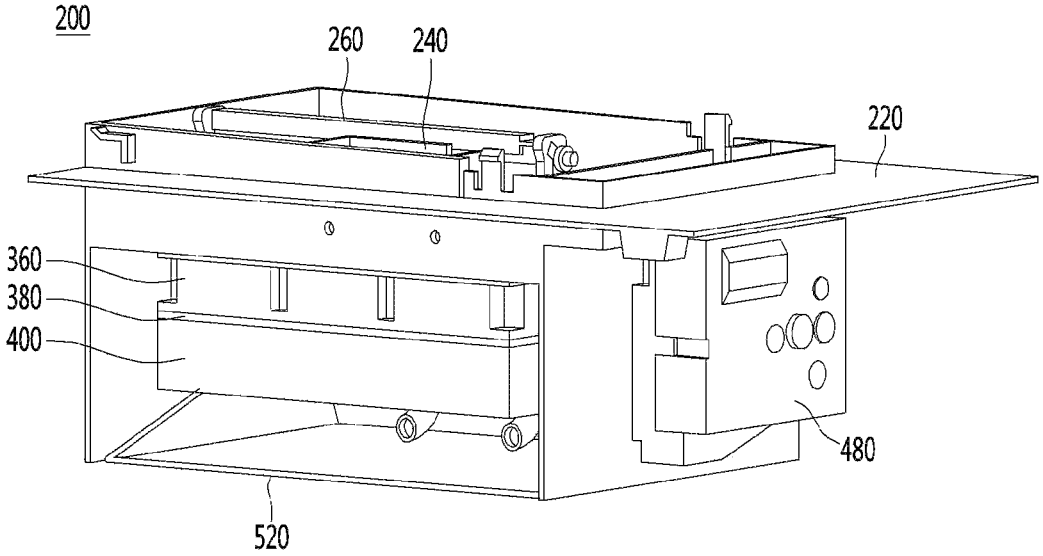
FIG. 2 is a perspective view of an ice maker according to an embodiment.
Figure 3:
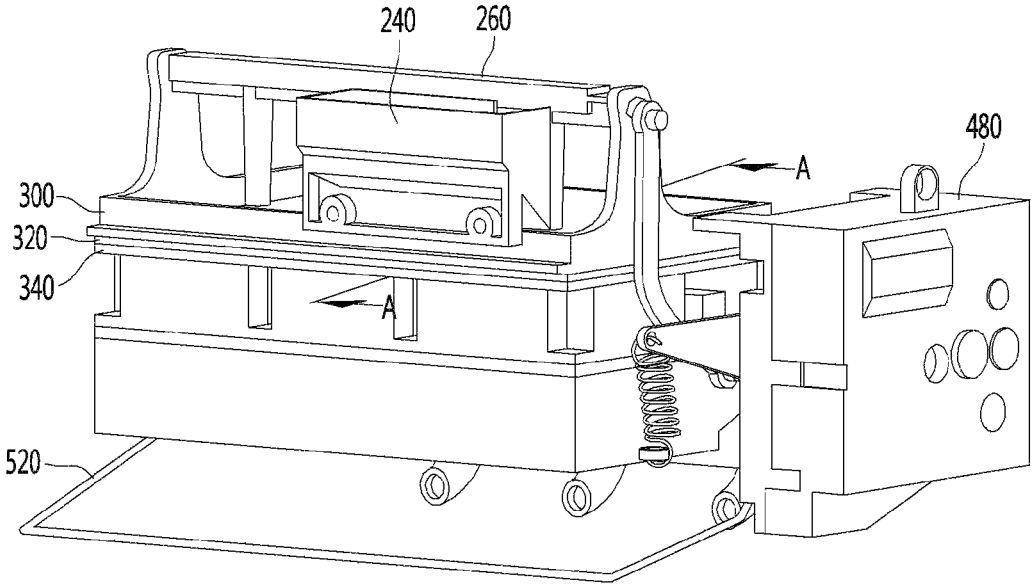
FIG. 3 is a perspective view illustrating a state in which a bracket is removed from the ice maker of FIG. 2.
Figure 4:
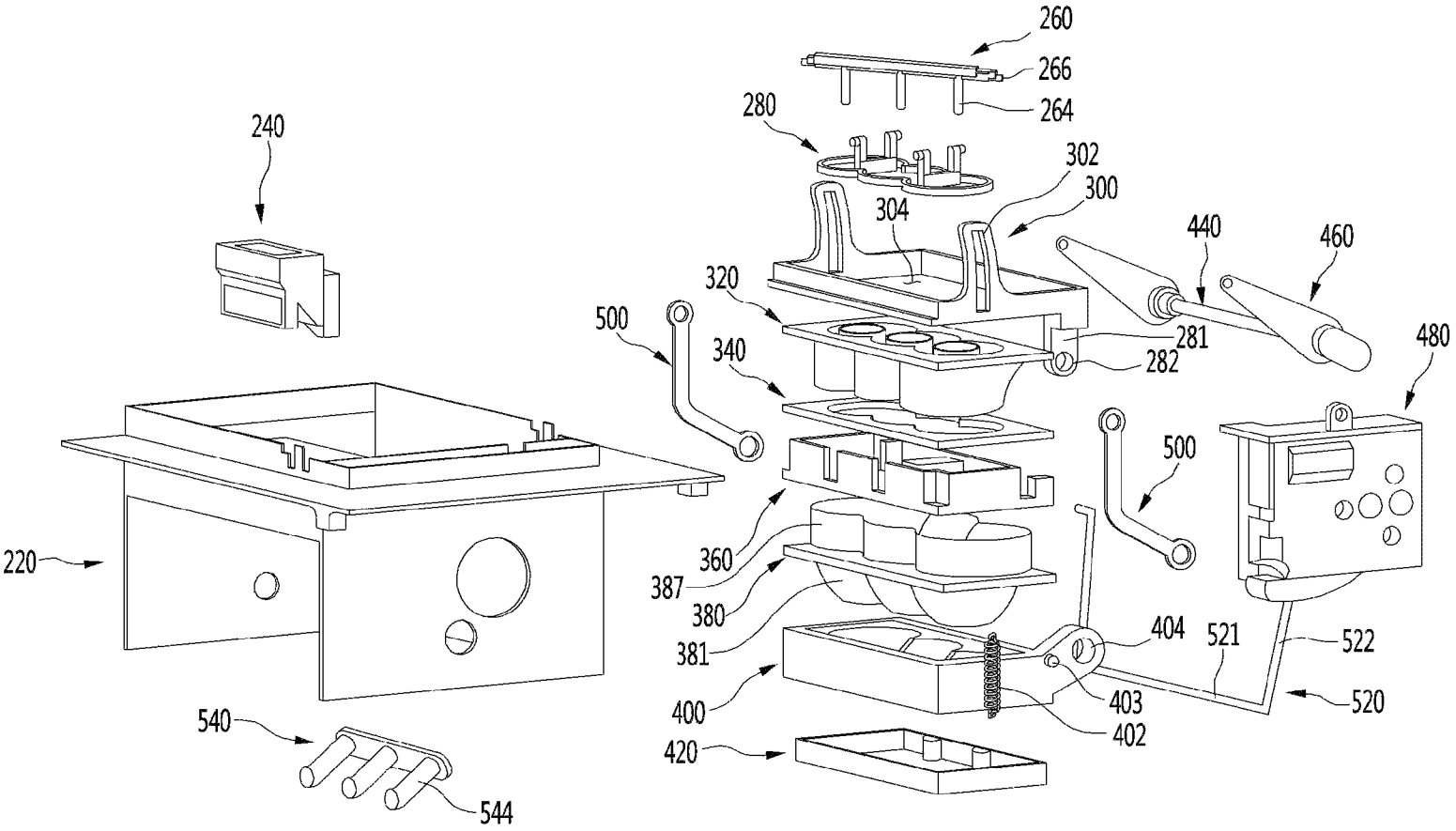
FIG. 4 is an exploded perspective view of the ice maker according to an embodiment.
Figure 5:
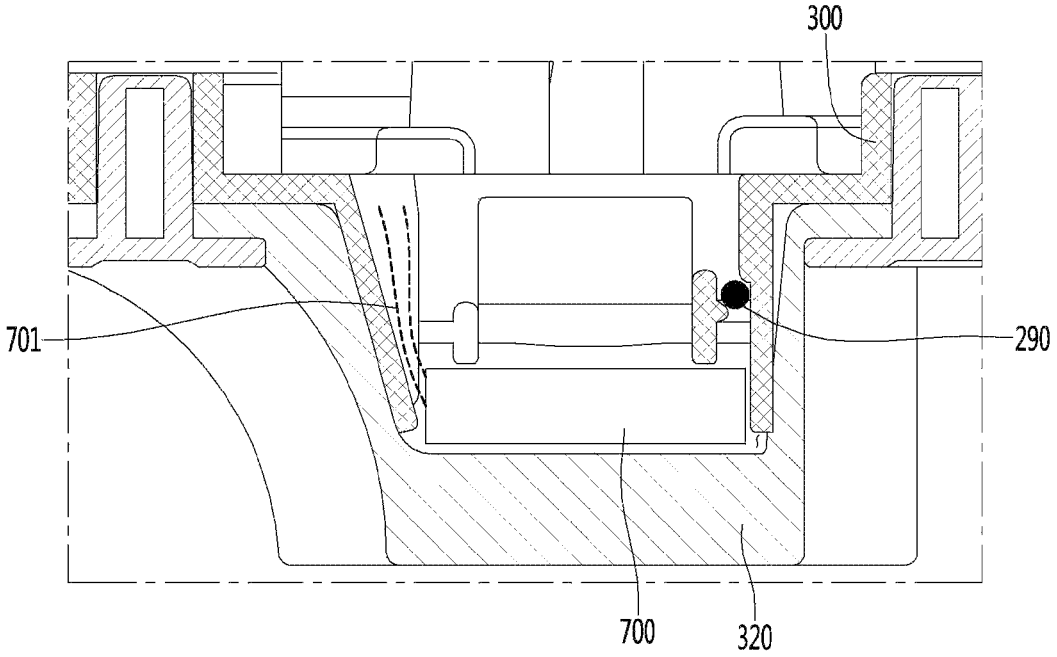
FIG. 5 is a cross-sectional view taken along line A-A of FIG. 3 for showing a second temperature sensor installed in an ice maker according to an embodiment.

FIG. 2 is a perspective view of an ice maker according to an embodiment, FIG. 3 is a perspective view illustrating a state in which a bracket is removed from the ice maker of FIG. 2, and FIG. 4 is an exploded perspective view of the ice maker according to an embodiment. FIG. 5 is a cross-sectional view taken along line A-A of FIG. 3 for showing a second temperature sensor installed in an ice maker according to an embodiment.

Figure 6:
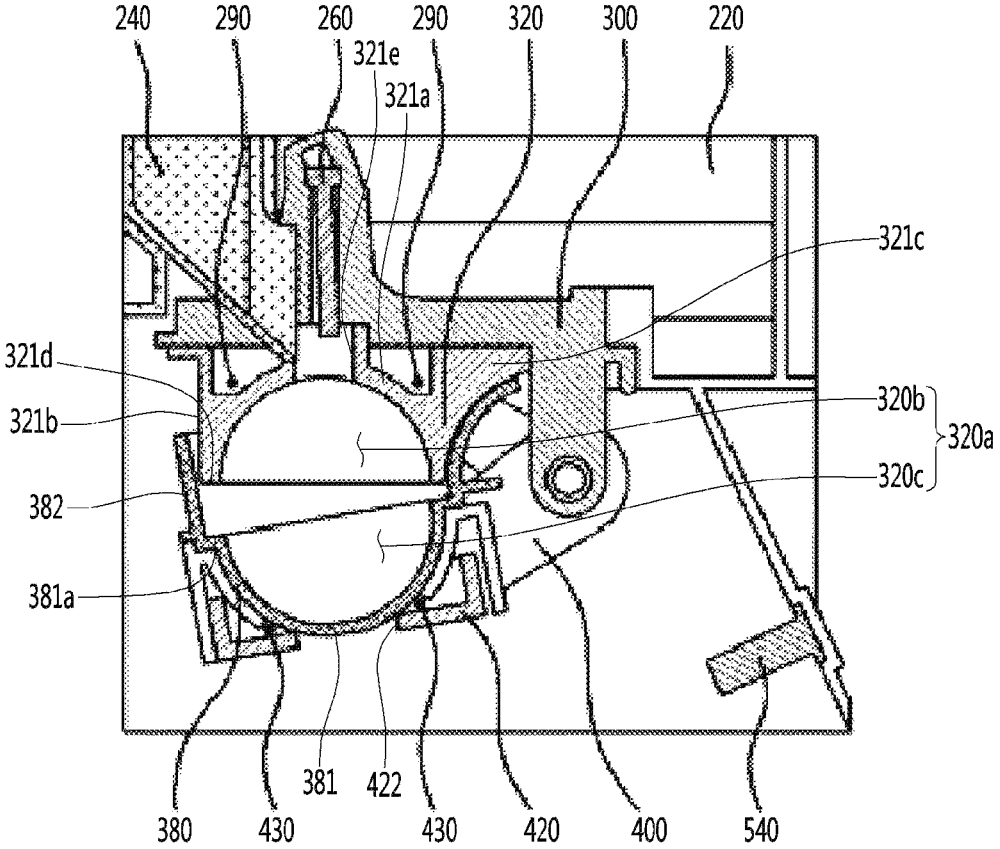
FIG. 6 is a longitudinal cross-sectional view of an ice maker when a second tray is disposed at a water supply position according to an embodiment.

FIG. 6 is a longitudinal cross-sectional view of an ice maker when a second tray is disposed at a water supply position according to an embodiment.

Referring to FIGS. 2 to 6, each component of the ice maker 200 may be provided inside or outside the bracket 220, and thus, the ice maker 200 may constitute one assembly.

The bracket 220 may be installed at, for example, the upper wall of the freezing compartment 32. A water supply part 240 may be installed on the upper side of the inner surface of the bracket 220. The water supply part 240 may be provided with openings at upper and lower sides so that water supplied to the upper side of the water supply part 240 may be guided to the lower side of the water supply part 240. Since the upper opening of the water supply part 240 is larger than the lower opening thereof, a discharge range of water guided downward through the water supply part 240 may be limited. A water supply pipe to which water is supplied may be installed above the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

The ice maker 200 may include an ice making cell 320*a* in which water is phase-changed into ice by the cold air.

The ice maker 200 may include a first tray 320 defining at least a portion of a wall for providing the ice making cell 320*a*, and a second tray 380 defining at least another portion of the wall for providing the ice making cell 320*a*.

Although not limited, the ice making cell 320*a* may include a first cell 320*b* and a second cell 320*c*. The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 contact each other, the complete ice making cell 320*a* may be defined.

On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is formed. Accordingly, the first tray 320 may be referred to as an upper tray, and the second tray 380 may be referred to as a lower tray.

A plurality of ice making cells 320*a* may be defined by the first tray 320 and the second tray 380.

When water is cooled by cold air while water is supplied to the ice making cell 320*a*, ice having the same or similar shape as that of the ice making cell 320*a* may be made.

In this embodiment, for example, the ice making cell 320*a* may be provided in a spherical shape or a shape similar to a spherical shape. In this case, the first cell 320*b* may be provided in a spherical shape or a shape similar to a spherical shape. Also, the second cell 320*c* may be provided in a spherical shape or a shape similar to a spherical shape. The ice making cell 320*a* may have a rectangular parallelepiped shape or a polygonal shape.

The ice maker 200 may further include a first tray case 300 coupled to the first tray 320.

For example, the first tray case 300 may be coupled to the upper side of the first tray 320. The first tray case 300 may be manufactured as a separate part from the bracket 220 and then may be coupled to the bracket 220 or integrally formed with the bracket 220.

The ice maker 200 may further include a first heater case 280. An ice separation heater 290 may be installed in the first heater case 280. The heater case 280 may be integrally formed with the first tray case 300 or may be separately formed.

The ice separation heater 290 may be disposed at a position adjacent to the first tray 320. The ice separation heater 290 may be, for example, a wire type heater. For example, the ice separation heater 290 may be installed to contact the first tray 320 or may be disposed at a position spaced a predetermined distance from the first tray 320. In any cases, the ice separation heater 290 may supply heat to the first tray 320, and the heat supplied to the first tray 320 may be transferred to the ice making cell 320*a*.

The ice maker 200 may further include a first tray cover 340 disposed below the first tray 320.

The first tray cover 340 may be provided with an opening corresponding to a shape of the ice making cell 320*a* of the first tray 320 and may be coupled to a lower surface of the first tray 320.

The first tray case 300 may be provided with a guide slot 302 inclined at an upper side and vertically extending at a lower side. The guide slot 302 may be provided in a member extending upward from the first tray case 300. A guide protrusion 266 of the first pusher 260, which will be described later, may be inserted into the guide slot 302. Thus, the guide protrusion 266 may be guided along the guide slot 302.

The first pusher 260 may include at least one extension part 264. For example, the first pusher 260 may include the extension part 264 provided with the same number as the number of ice making cells 320*a*, but is not limited thereto. The extension part 264 may push out the ice disposed in the ice making cell 320*a* during the ice separation process. For example, the extension part 264 may be inserted into the ice making cell 320*a* through the first tray case 300. Therefore, the first tray case 300 may be provided with a hole 304 through which a portion of the first pusher 260 passes.

The guide protrusion 266 of the first pusher 260 may be coupled to a pusher link 500. In this case, the guide protrusion 266 may be coupled to the pusher link 500 so as to be rotatable. Therefore, when the pusher link 500 moves, the first pusher 260 may also move along the guide slot 302.

The ice maker 200 may further include a second tray case 400 coupled to the second tray 380.

The second tray case 400 may be disposed at a lower side of the second tray to support the second tray 380. For example, at least a portion of the wall defining the second cell 320*c* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray cover 360.

The second tray 380 may include a circumferential wall 382 surrounding a portion of the first tray 320 in a state of contacting the first tray 320. The second tray cover 360 may cover the circumferential wall 382.

The ice maker 200 may further include a second heater case 420. A transparent ice heater 430 may be installed in the second heater case 420.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an ice making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

At least one of the first tray 320 and the second tray 380 may be made of a resin including plastic so that the ice attached to the trays 320 and 380 is separated in the ice making process.

At least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. The transparent ice heater 430 may be, for example, a wire type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray case 400. In any cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480.

One end of the rotation arm 460 may be connected to one end of the spring 402, and thus, a position of the rotation arm 460 may move to an initial value by restoring force when the spring 402 is tensioned.

The driver 480 may include a motor and a plurality of gears.

A full ice detection lever 520 may be connected to the driver 480. The full ice detection lever 520 may also rotate by the rotational force provided by the driver 480.

The full ice detection lever 520 may have a 'ㄷ' shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray case 300. The full ice detection lever 520 may rotate to detect ice stored in the ice bin 600.

The driver 480 may further include a cam that rotates by the rotational power of the motor.

The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position and an ice making position, which will be described later, may be distinguished and determined based on the signals outputted from the sensor.

The ice maker 200 may further include a second pusher 540. The second pusher 540 may be installed on the bracket 220.

The second pusher 540 may include at least one extension part 544. For example, the second pusher 540 may include the extension part 544 provided with the same number as the number of ice making cells 320*a*, but is not limited thereto. The extension part 544 may push out the ice disposed in the ice making cell 320*a*. For example, the extension part 544 may pass through the second tray case 400 to contact the second tray 380 defining the ice making cell 320*a* and then press the contacting second tray 380. Therefore, the second tray case 400 may be provided with a hole 422 through which a portion of the second pusher 540 passes.

The first tray case 300 may be rotatably coupled to the second tray case 400 with respect to the shaft 440 and then be disposed to change in angle about the shaft 440.

In this embodiment, the second tray 380 may be made of a non-metal material. For example, when the second tray 380 is pressed by the second pusher 540, the second tray 380 may be made of a flexible material which is deformable. Although not limited, the second tray 380 may be made of a silicone material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380.

Also, if the second tray 380 is made of the non-metal material and the flexible or soft material, after the shape of the second tray 380 is deformed by the second pusher 540, when the pressing force of the second pusher 540 is removed, the second tray 380 may be easily restored to its original shape.

On the other hand, the first tray 320 may be made of a metal material. In this case, since the coupling force or the separating force between the first tray 320 and the ice is strong, the ice maker 200 according to this embodiment may include at least one of the ice separation heater 290 or the first pusher 260.

For another example, the first tray 320 may be made of a non-metal material. When the first tray 320 is made of the non-metal material, the ice maker 200 may include only one of the ice separation heater 290 and the first pusher 260.

Alternatively, the ice maker 200 may not include the ice separation heater 290 and the first pusher 260.

Although not limited, the first tray 320 may be made of a silicone material. That is, the first tray 320 and the second tray 380 may be made of the same material. When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

On the other hand, referring to FIG. 5, the ice maker 200 may further include a second temperature sensor (or a tray temperature sensor) 700 that senses the temperature of the ice making cell 320*a*. The second temperature sensor 700 may sense a temperature of water or ice of the ice making cell 320*a*.

The second temperature sensor 700 may be disposed adjacent to the first tray 320 to sense the temperature of the first tray 320, thereby indirectly determining the water temperature or the ice temperature of the ice making cell 320*a*. In this embodiment, the water temperature or the ice temperature of the ice making cell 320*a* may be referred to as an internal temperature of the ice making cell 320*a*. The second temperature sensor 700 may be installed in the first tray case 300.

In this case, the second temperature sensor 700 may contact the first tray 320, or may be spaced apart from the first tray 320 by a predetermined distance. Alternatively, the second temperature sensor 700 may be installed on the first tray 320 to contact the first tray 320.

Of course, when the second temperature sensor 700 is disposed to pass through the first tray 320, the temperature of water or ice of the ice making cell 320*a* may be directly sensed.

On the other hand, a portion of the ice separation heater 290 may be disposed higher than the second temperature sensor 700 and may be spaced apart from the second temperature sensor 700. An electric wire 701 coupled to the second temperature sensor 700 may be guided above the first tray case 300.

Referring to FIG. 6, the ice maker 200 according to this embodiment may be designed such that the position of the second tray 380 is different in the water supply position and the ice-making position.

For example, the second tray 380 may include a second cell wall 381 defining the second cell 320*c* of the ice making cell 320*a*, and a circumferential wall 382 extending along the outer edge of the second cell wall 381.

The second cell wall 381 may include an upper surface 381*a*. In this specification, the upper surface 381*a* of the second cell wall 381 may be referred to as the upper surface 381*a* of the second tray 380. The upper surface 381*a* of the second cell wall 381 may be disposed lower than the upper end of the circumferential wall 381.

The first tray 320 may include a first cell wall 321*a* defining the first cell 320*b* of the ice making cell 320*a*. The first cell wall 321*a* may include a straight portion 321*b* and a curved portion 321*c*. The curved portion 321*c* may be formed in an arc shape having a center of the shaft 440 as a radius of curvature. Accordingly, the circumferential wall 381 may also include a straight portion and a curved portion corresponding to the straight portion 321*b* and the curved portion 321*c*.

The first cell wall 321*a* may include a lower surface 321*d*. In this specification, the lower surface 321*b* of the first cell wall 321*a* may be referred to as the lower surface 321*b* of the first tray 320. The lower surface 321*d* of the first cell wall 321*a* may contact the upper surface 381*a* of the second cell wall 381*a*.

For example, at least a portion of the lower surface 321*d* of the first cell wall 321*a* and the upper surface 381*a* of the second cell wall 381 may be spaced apart at the water supply position as shown in FIG. 6.

In FIG. 6, for example, it is shown that the lower surface 321*d* of the first cell wall 321*a* and the entire upper surface 381*a* of the second cell wall 381 are spaced apart from each other.

Accordingly, the upper surface 381*a* of the second cell wall 381 may be inclined to form a predetermined angle with the lower surface 321*d* of the first cell wall 321*a*.

Although not limited, the lower surface 321*d* of the first cell wall 321*a* at the water supply position may be maintained substantially horizontally, and the upper surface 381*a* of the second cell wall 381 may be disposed to be inclined with respect to the lower surface 321*d* of the first cell wall 321*a* under the first cell wall 321*a*.

In the state shown in FIG. 6, the circumferential wall 382 may surround the first cell wall 321*a*. In addition, the upper end of the circumferential wall 382 may be disposed higher than the lower surface 321*d* of the first cell wall 321*a*.

Figure 12:
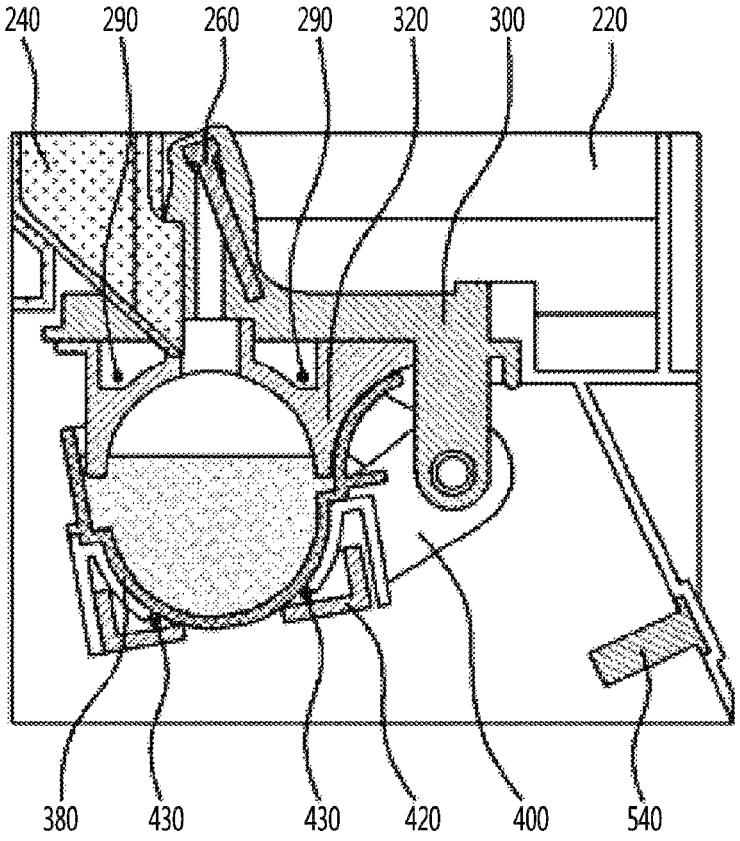
FIG. 12 is a view illustrating a state in which supply of water is completed at a water supply position in FIG. 54.

On the other hand, the upper surface 381*a* of the second cell wall 381 may contact at least a portion of the lower surface 321*d* of the first cell wall 321*a* at the ice making position (see FIG. 12).

The angle formed by the upper surface 381*a* of the second tray 380 and the lower surface 321*d* of the first tray 320 at the ice making position is smaller than the angle formed by the upper surface 381*a* of the second tray 380 and the lower surface 321*d* of the first tray 320 at the water supply position.

The upper surface 381*a* of the second cell wall 381 may contact the entire lower surface 321*d* of the first cell wall 321*a* at the ice making position. At the ice making position, the upper surface 381*a* of the second cell wall 381 and the lower surface 321*d* of the first cell wall 321*a* may be disposed to be substantially horizontal.

In this embodiment, the water supply position of the second tray 380 and the ice making position are different from each other so that, when the ice maker 200 includes a plurality of ice making cells 320*a*, a water passage for communication between the ice making cells 320*a* is not formed in the first tray 320 and/or the second tray 380, and water is uniformly distributed to the plurality of ice making cells 320*a*.

If the ice maker 200 includes the plurality of ice making cells 320*a*, when the water passage is formed in the first tray 320 and/or the second tray 380, the water supplied to the ice maker 200 is distributed to the plurality of ice making cells 320*a* along the water passage.

However, in a state in which the water is distributed to the plurality of ice making cells 320*a*, water also exists in the water passage, and when ice is made in this state, the ice made in the ice making cell 320*a* is connected by the ice made in the water passage.

In this case, there is a possibility that the ice will stick together even after the ice separation is completed. Even if pieces of ice are separated from each other, some pieces of ice will contain ice made in the water passage, and thus there is a problem that the shape of the ice is different from that of the ice making cell.

However, as in this embodiment, when the second tray 380 is spaced apart from the first tray 320 at the water supply position, water falling into the second tray 380 may be uniformly distributed to the plurality of second cells 320*c* of the second tray 380.

For example, the first tray 320 may include a communication hole 321*e*. When the first tray 320 includes one first cell 320*b*, the first tray 320 may include one communication hole 321*e*. When the first tray 320 includes a plurality of first cells 320*b*, the first tray 320 may include a plurality of communication holes 321*e*. The water supply part 240 may supply water to one communication hole 321*e* among the plurality of communication holes 321*e*. In this case, the water supplied through the one communication hole 321*e* falls into the second tray 380 after passing through the first tray 320.

During the water supply process, water may fall into any one second cell 320*c* among the plurality of second cells 320*c* of the second tray 380. The water supplied to one second cell 320*c* overflows from one second cell 320*c*.

In this embodiment, since the upper surface 381*a* of the second tray 380 is spaced apart from the lower surface 321*d* of the first tray 320, the water that overflows from one of the second cells 320*c* moves to another adjacent second cell 320*c* along the upper surface 381*a* of the second tray 380. Accordingly, the plurality of second cells 320*c* of the second tray 380 may be filled with water.

In addition, in a state in which the supply of water is completed, a portion of the supplied water is filled in the second cell 320*c*, and another portion of the supplied water may be filled in a space between the first tray 320 and the second tray 380.

Water at the water supply position when water supply is completed may be positioned only in the space between the first tray 320 and the second tray 380, the space between the first tray 320 and the second tray 380, and the first tray 320 according to the volume of the ice making cell 320*a* (see FIG. 12).

When the second tray 380 moves from the water supply position to the ice making position, the water in the space between the first tray 320 and the second tray 380 may be uniformly distributed to the plurality of first cells 320*b*.

On the other hand, when the water passage is defined in the first tray 320 and/or the second tray 380, ice made in the ice making cell 320*a* is also made in the water passage portion.

In this case, when the controller of the refrigerator controls one or more of the cooling power of the cooling air supply part 900 and the heating amount of the transparent ice heater 430 to vary according to the mass per unit height of water in the ice making cell 320*a* in order to make transparent ice, one or more of the cooling power of the cold air supply part 900 and the heating amount of the transparent ice heater 430 are controlled to rapidly vary several times or more in the portion where the water passage is defined.

This is because the mass per unit height of water is rapidly increased several times or more in the portion where the water passage is defined. In this case, since the reliability problem of the parts may occur and expensive parts with large widths of maximum and minimum output may be used, it can also be disadvantageous in terms of power consumption and cost of parts. As a result, the present disclosure may require a technology related to the above-described ice making position so as to make transparent ice.

Figure 7:
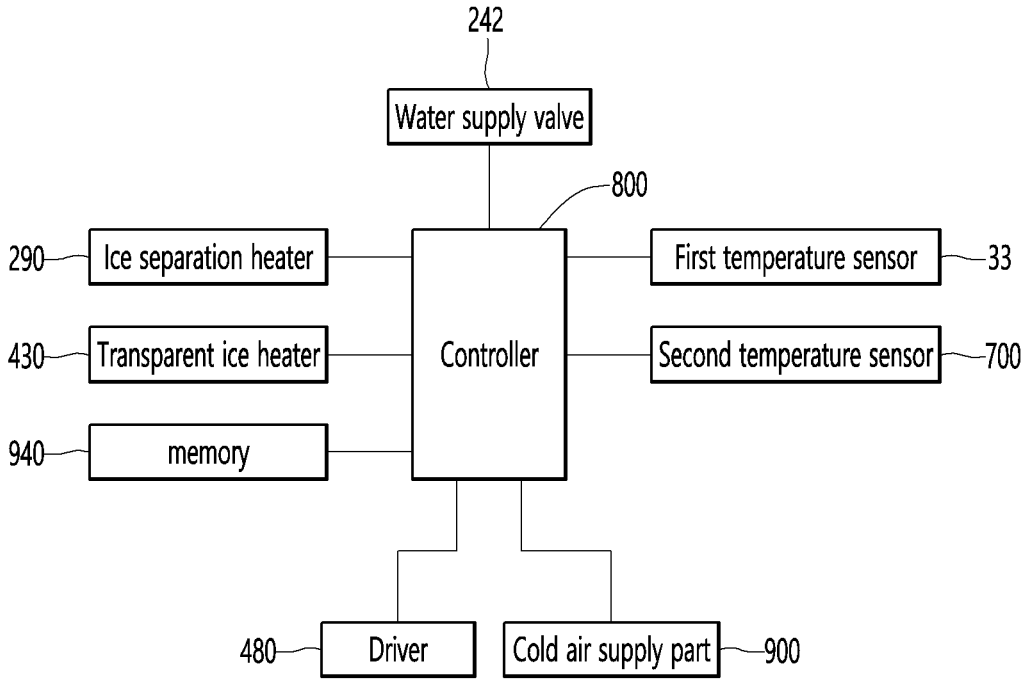
FIG. 7 is a block diagram illustrating a control of a refrigerator according to an embodiment.

FIG. 7 is a block diagram illustrating a control of a refrigerator according to an embodiment.

Referring to FIG. 7, the refrigerator according to this embodiment may further include a cold air supply part 900 supplying cold air to the freezing compartment 32 (or the ice making cell). The cold air supply part 900 may supply cold air to the freezing compartment 32 using a refrigerant cycle.

For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary.

Therefore, in this embodiment, the cold air supply part 900 may include one or more of the compressor, the fan, and the refrigerant valve.

The refrigerator according to this embodiment may further include a controller 800 that controls the cold air supply part 900.

The refrigerator may further include a water supply valve 242 controlling an amount of water supplied through the water supply part 240.

The controller 800 may control a portion or all of the ice separation heater 290, the transparent ice heater 430, the driver 480, the cold air supply part 900, and the water supply valve 242.

In this embodiment, when the ice maker 200 includes both the ice separation heater 290 and the transparent ice heater 430, an output of the ice separation heater 290 and an output of the transparent ice heater 430 may be different from each other. When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented.

Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 (or an internal temperature sensor) that senses a temperature of the freezing compartment 32.

The controller 800 may control the cold air supply part 900 based on the temperature sensed by the first temperature sensor 33. The controller 800 may determine whether ice making is completed based on the temperature sensed by the second temperature sensor 700.

The refrigerator may further include a memory 940 that prestores a water supply amount. In this embodiment, the memory 940 may store a first water supply amount when the transparent ice heater 430 operates normally and a second water supply amount when the transparent ice heater 430 does not operate normally.

Figure 8:
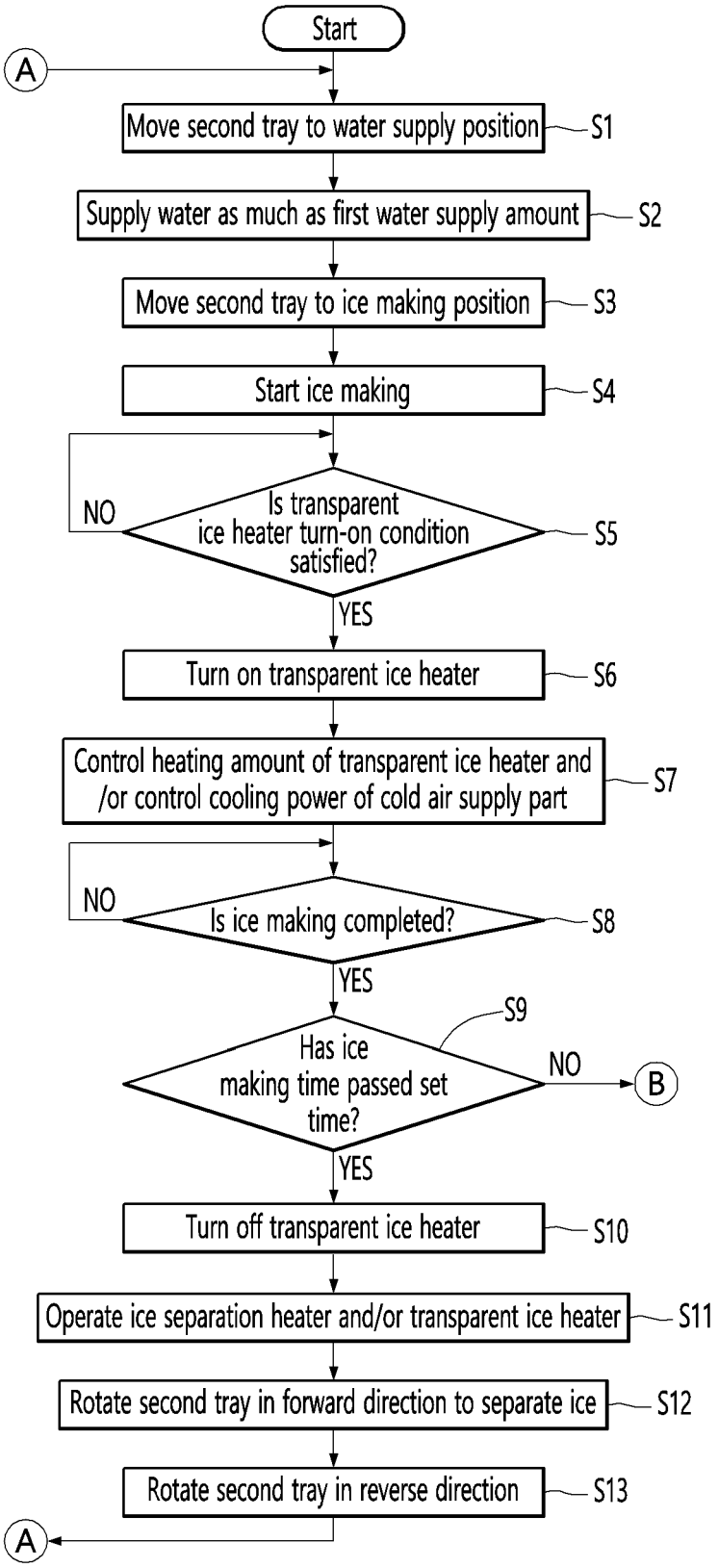
FIGS. 8 and 9 are flowcharts for explaining a process of making ice in the ice maker according to an embodiment.
Figure 9:
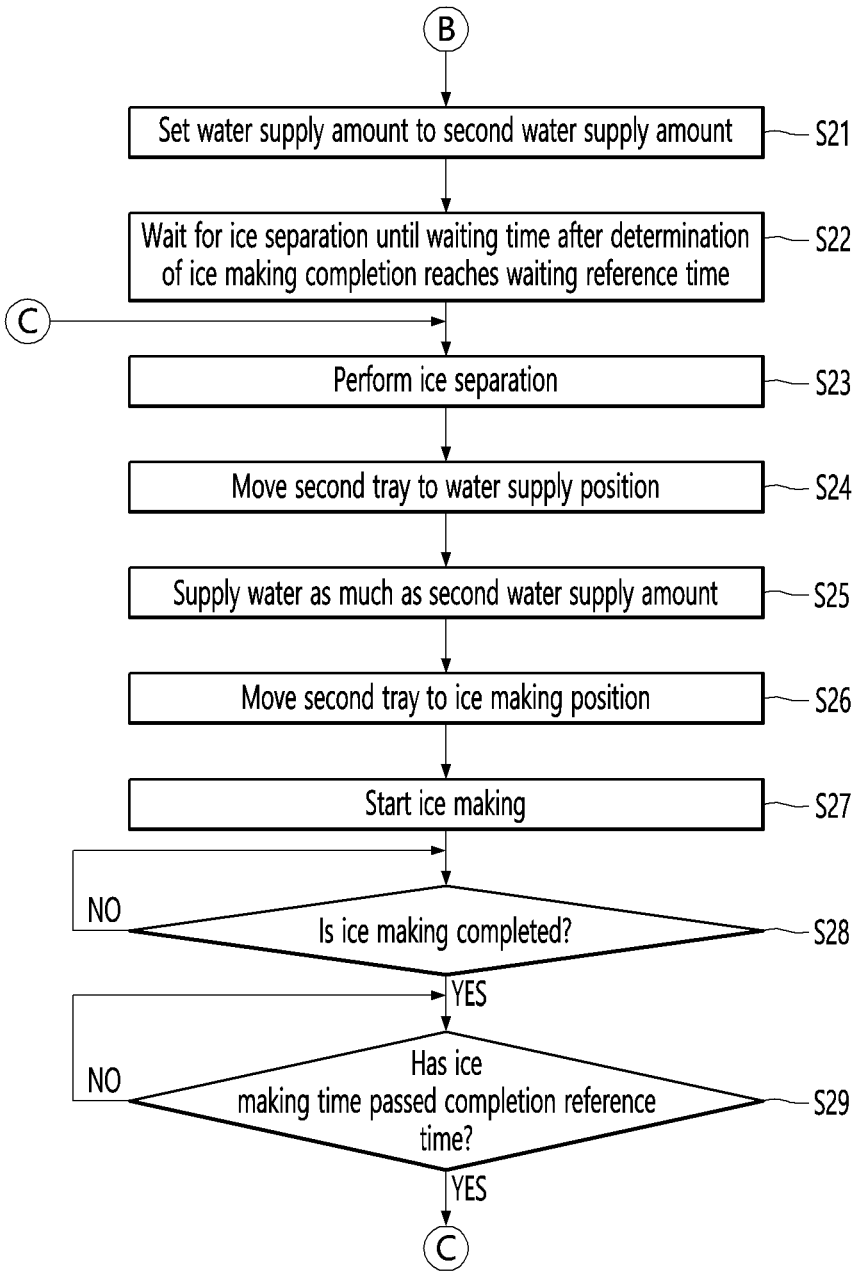

FIGS. 8 and 9 are flowcharts for explaining a process of making ice in the ice maker according to an embodiment.

Figure 10:
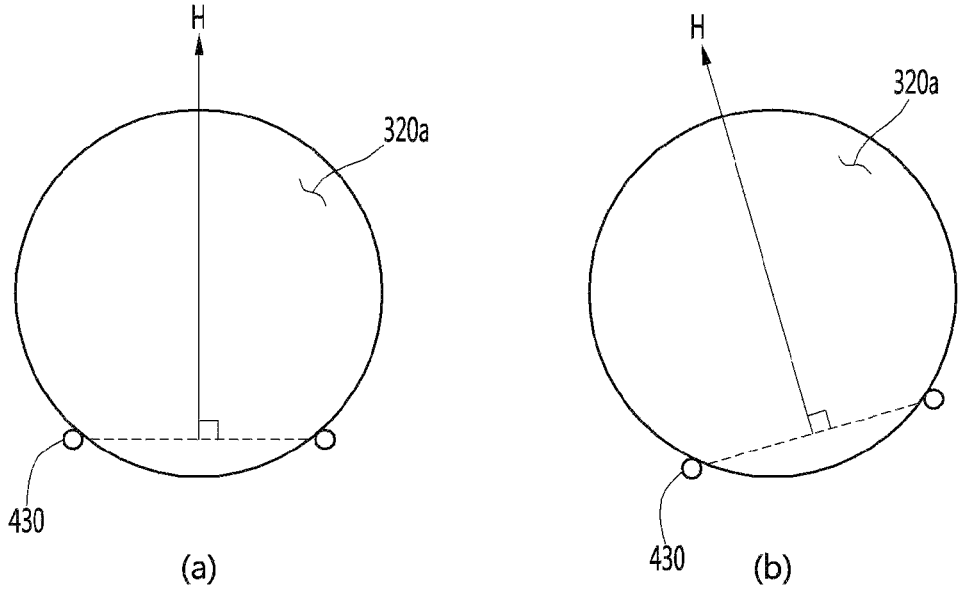
FIG. 10(*a*)-(*b*) is a view for explaining a height reference depending on a relative position of the transparent heater with respect to the ice making cell.
Figure 11:
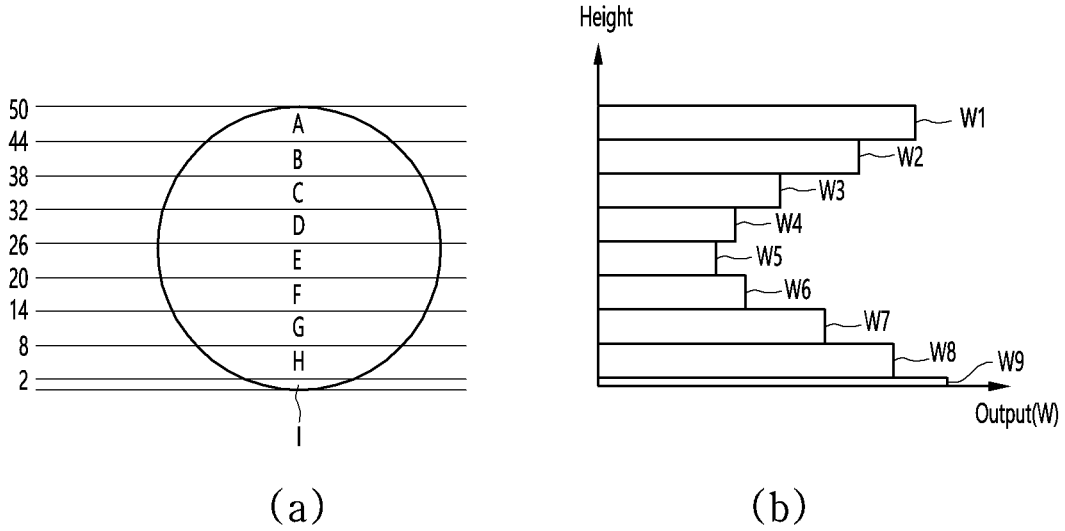
FIG. 11(*a*)-(*b*) is a view for explaining an output of the transparent heater per unit height of water within the ice making cell.

FIG. 10(*a*)-(*b*) is a view for explaining a height reference depending on a relative position of the transparent heater with respect to the ice making cell, and FIG. 11(*a*)-(*b*) is a view for explaining an output of the transparent heater per unit height of water within the ice making cell.

Figure 13:
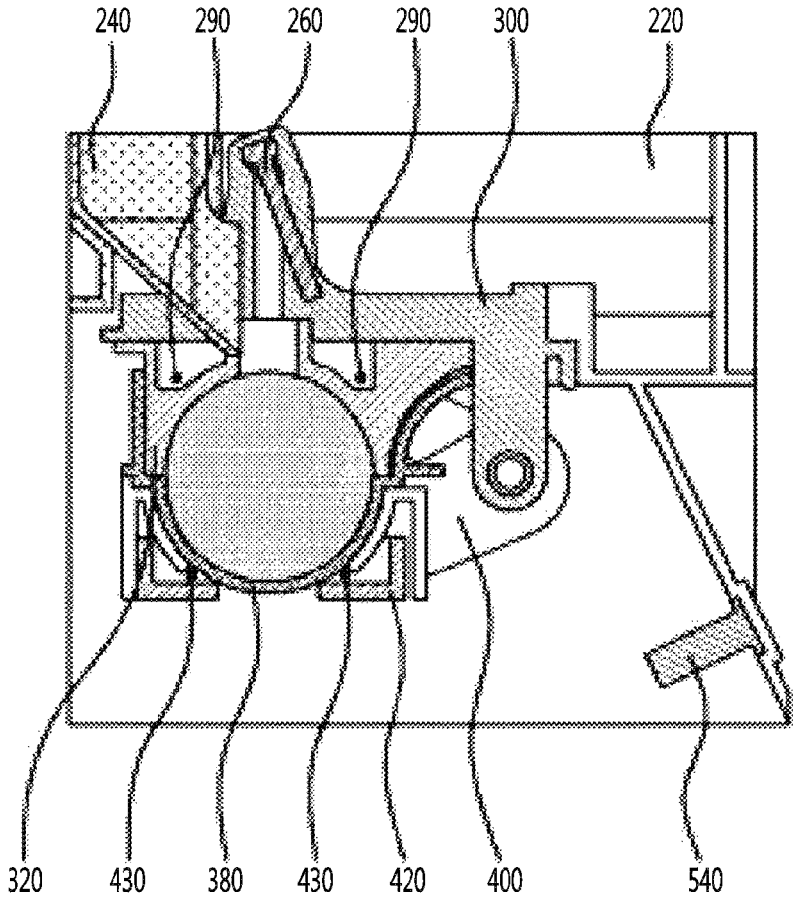
FIG. 13 is a view illustrating a state in which ice is made at an ice making position.
Figure 14:
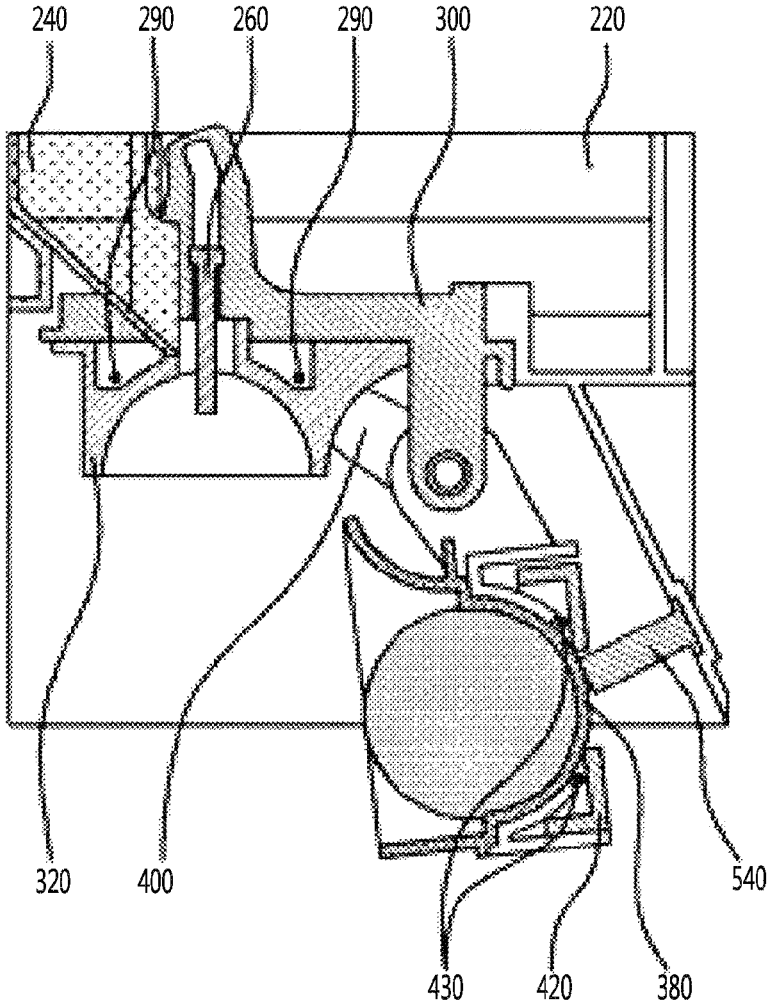
FIG. 14 is a view illustrating a state in which a second tray is separated from a first tray during an ice separation process.
Figure 15:
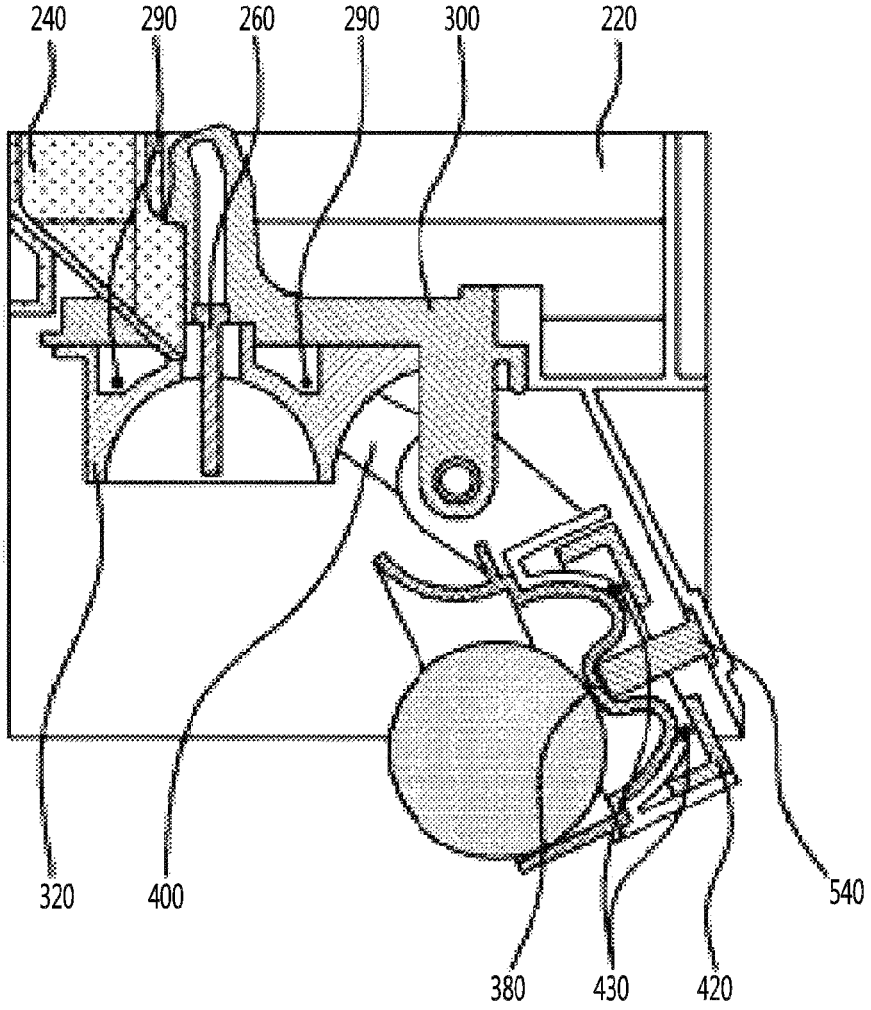
FIG. 15 is a view illustrating a state in which a second tray is moved to an ice separation position during an ice separation process.

FIG. 12 is a view illustrating a state in which supply of water is completed at a water supply position, FIG. 13 is a view illustrating a state in which ice is made at an ice making position, FIG. 14 is a view illustrating a state in which a second tray is separated from a first tray during an ice separation process, and FIG. 15 is a view illustrating a state in which a second tray is moved to an ice separation position during an ice separation process.

Referring to FIGS. 6 to 15, to make ice in the ice maker 200, the controller 800 moves the second tray 380 to a water supply position (51).

In this specification, a direction in which the second tray 380 moves from the ice making position of FIG. 13 to the ice separation position of FIG. 15 may be referred to as forward movement (or forward rotation). On the other hand, the direction from the ice separation position of FIG. 15 to the water supply position of FIG. 12 may be referred to as reverse movement (or reverse rotation).

The movement to the water supply position of the second tray 380 is detected by a sensor, and when it is detected that the second tray 380 moves to the water supply position, the controller 800 stops the driver 480.

The water supply starts when the second tray 380 moves to the water supply position (S2).

Hereinafter, an example in which the transparent ice heater 430 operates normally in the previous ice making process will be described.

When the transparent ice heater 430 operates normally during the previous ice making process, water is supplied to the ice making cell 320*a* as much as the first water supply amount. For the water supply, the controller 800 may turn on the water supply valve 242, and when it is determined that an amount of water corresponding to the first water supply amount is supplied, the controller 800 may turn off the water supply valve 242.

For example, in the process of supplying water, when a pulse is outputted from a flow rate sensor (not shown) and the outputted pulse reaches a first reference pulse corresponding to the first water supply amount, it may be determined that an amount of water corresponding to the first water supply amount is supplied.

After the water supply is completed, the controller 800 controls the driver 480 to allow the second tray 380 to move to the ice making position (S3). For example, the controller 800 may control the driver 480 to allow the second tray 380 to move from the water supply position in the reverse direction.

When the second tray 380 moves in the reverse direction, the upper surface 381*a* of the second tray 380 comes close to the lower surface 321*d* of the first tray 320. Then, water between the upper surface 381*a* of the second tray 380 and the lower surface 321*d* of the first tray 320 is divided into each of the plurality of second cells 320*c* and then is distributed. When the upper surface 381*a* of the second tray 380 and the lower surface 321*d* of the first tray 320 are completely in close contact, the first cell 320*b* is filled with water.

The movement to the ice making position of the second tray 380 is detected by a sensor, and when it is detected that the second tray 380 moves to the ice making position, the controller 800 stops the driver 480.

In the state in which the second tray 380 moves to the ice making position, ice making is started (S4). For example, the ice making may be started when the second tray 380 reaches the ice making position. Alternatively, when the second tray 380 reaches the ice making position, and the water supply time elapses, the ice making may be started.

When ice making is started, the controller 800 may control the cold air supply part 900 to supply cold air to the ice making cell 320*a*.

After the ice making is started, the controller 800 may control the transparent ice heater 430 to be turned on in at least partial sections of the cold air supply part 900 supplying the cold air to the ice making cell 320*a*.

When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied (S5).

In this embodiment, the transparent ice heater 430 is not turned on immediately after the ice making is started, and the transparent ice heater 430 may be turned on only when the turn-on condition of the transparent ice heater 430 is satisfied (S6).

Generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray 380 reaches the ice making position, a time point at which the water supply is completed, and the like.

Alternatively, the controller 800 determines that the turn-on condition of the transparent ice heater 430 is satisfied when a temperature sensed by the second temperature sensor 700 reaches a turn-on reference temperature.

For example, the turn-on reference temperature may be a temperature for determining that water starts to freeze at the uppermost side (communication hole side) of the ice making cell 320*a*. When a portion of the water is frozen in the ice making cell 320*a*, the temperature of the ice in the ice making cell 320*a* is below zero.

The temperature of the first tray 320 may be higher than the temperature of the ice in the ice making cell 320*a*.

Alternatively, although water is present in the ice making cell 320*a*, after the ice starts to be made in the ice making cell 320*a*, the temperature sensed by the second temperature sensor 700 may be below zero.

Thus, to determine that making of ice is started in the ice making cell 320*a* on the basis of the temperature sensed by the second temperature sensor 700, the turn-on reference temperature may be set to the below-zero temperature.

That is, when the temperature sensed by the second temperature sensor 700 reaches the turn-on reference temperature, since the turn-on reference temperature is below zero, the ice temperature of the ice making cell 320*a* is below zero, i.e., lower than the turn-on reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*.

For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the control part 800 may control the cooling power and/or the heating amount so that the cooling power of the cold air supply part 900 and/or the heating amount of the transparent ice heater 430 is variable according to the mass per unit height of the water of the ice making cell 320*a*.

In this specification, the variable of the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and a sum of the turn-on time and the turn-off time of the transparent ice heater 430 in one cycle, or a ratio of the turn-off time and a sum of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

For example, as shown in FIG. 10(*a*), the transparent ice heater 430 at the bottom surface of the ice making cell 320*a* may be disposed to have the same height. In this case, a line connecting the transparent ice heater 430 is a horizontal line, and a line extending in a direction perpendicular to the horizontal line serves as a reference for the unit height of the water of the ice making cell 320*a*.

In the case of FIG. 10(*a*), ice is made from the uppermost side of the ice making cell 320*a* and then is grown.

On the other hand, as shown in FIG. 10(*b*), the transparent ice heater 430 at the bottom surface of the ice making cell 320*a* may be disposed to have different heights.

In this case, since heat is supplied to the ice making cell 320*a* at different heights of the ice making cell 320*a*, ice is made with a pattern different from that of FIG. 10(*a*). For example, in FIG. 10(*b*), ice may be made at a position spaced apart from the uppermost side to the left side of the ice making cell 320*a*, and the ice may be grown to a right lower side at which the transparent ice heater 430 is disposed.

Accordingly, in FIG. 10(*b*), a line (reference line) perpendicular to the line connecting two points of the transparent ice heater 430 serves as a reference for the unit height of water of the ice making cell 320*a*. The reference line of FIG. 10(*b*) is inclined at a predetermined angle from the vertical line.

FIG. 11(*a*)-(*b*) illustrates a unit height division of water and an output amount of transparent ice heater per unit height when the transparent ice heater is disposed as shown in FIG. 10(*a*).

Hereinafter, an example of controlling an output of the transparent ice heater so that the ice making rate is constant for each unit height of water will be described.

Referring to FIG. 11(*a*)-(*b*), when the ice making cell 320*a* is formed, for example, in a spherical shape, the mass per unit height of water in the ice making cell 320*a* increases from the upper side to the lower side to reach the maximum and then decreases again.

For example, the water (or the ice making cell itself) in the spherical ice making cell 320*a* having a diameter of about 50 mm is divided into nine sections (section A to section I) by 6 mm height (unit height). Here, it is noted that there is no limitation on the size of the unit height and the number of divided sections.

When the water in the ice making cell 320*a* is divided into unit heights, the height of each section to be divided is equal to the section A to the section H, and the section I is lower than the remaining sections. Alternatively, the unit heights of all divided sections may be the same depending on the diameter of the ice making cell 320*a* and the number of divided sections.

Among the many sections, the section E is a section in which the mass of unit height of water is maximum. For example, in the section in which the mass per unit height of water is maximum, when the ice making cell 320*a* has spherical shape, a diameter of the ice making cell 320*a*, a horizontal cross-sectional area of the ice making cell 320*a*, or a circumference of the ice may be maximum.

As described above, when assuming that the cooling power of the cold air supply part 900 is constant, and the output of the transparent ice heater 430 is constant, the ice making rate in section E is the lowest, the ice making rate in the sections A and I is the fastest.

In this case, since the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

Specifically, since the mass of the section E is the largest, the output W5 of the transparent ice heater 430 in the section E may be set to a minimum value. Since the volume of the section D is less than that of the section E, the volume of the ice may be reduced as the volume decreases, and thus it is necessary to delay the ice making rate. Thus, an output W4 of the transparent ice heater 430 in the section D may be set to a value greater than an output W5 of the transparent ice heater 430 in the section E.

Since the volume in the section C is less than that in the section D by the same reason, an output W3 of the transparent ice heater 430 in the section C may be set to a value greater than the output W4 of the transparent ice heater 430 in the section D.

Since the volume in the section B is less than that in the section C, an output W2 of the transparent ice heater 430 in the section B may be set to a value greater than the output W3 of the transparent ice heater 430 in the section C. Since the volume in the section A is less than that in the section B, an output W1 of the transparent ice heater 430 in the section A may be set to a value greater than the output W2 of the transparent ice heater 430 in the section B.

For the same reason, since the mass per unit height decreases toward the lower side in the section E, the output of the transparent ice heater 430 may increase as the lower side in the section E (see W6, W7, W8, and W9).

Thus, according to an output variation pattern of the transparent ice heater 430, the output of the transparent ice heater 430 is gradually reduced from the first section to the intermediate section after the transparent ice heater 430 is initially turned on.

The output of the transparent ice heater 430 may be minimum in the intermediate section in which the mass of unit height of water is minimum. The output of the transparent ice heater 430 may again increase step by step from the next section of the intermediate section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

As described above, even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may gradually increase.

The cooling power of the cold air supply part 900 may be maximum in the intermediate section in which the mass for each unit height of water is minimum. The cooling power of the cold air supply part 900 may be gradually reduced again from the next section of the intermediate section.

Alternatively, the transparent ice may be made by varying the cooling power of the cold air supply part 900 and the heating amount of the transparent ice heater 430 according to the mass for each unit height of water.

For example, the heating power of the transparent ice heater 430 may vary so that the cooling power of the cold air supply part 900 is proportional to the mass per unit height of water and inversely proportional to the mass for each unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

The controller 800 may determine whether the ice making is completed based on the temperature sensed by the second temperature sensor 700 (S8).

For example, when the temperature sensed by the second temperature sensor 700 reaches a first reference temperature, the controller 800 may determine that the ice making is completed.

When the controller 800 determines that the temperature sensed by the second temperature sensor 700 has reached the first reference temperature, the controller 800 may determine whether the ice making time (elapsed time having elapsed from the ice making start time point to the ice making completion time point) has elapsed (S9).

Alternatively, without distinguishing from operation S9, the controller 800 may determine whether the elapsed time having elapsed from the start of the ice making until the temperature sensed by the second temperature sensor 700 reaches the first reference temperature has passed a set time.

When the temperature sensed by the second temperature sensor 700 reaches the first reference temperature regardless of the operation of the transparent ice heater 430, ice may be entirely made at least on the surface contacting the ice making cell 320*a*.

The ice making time until the temperature sensed by the second temperature sensor 700 reaches the first reference temperature in a state in which the transparent ice heater 430 is turned off may be referred to as a first time (a).

The ice making time until the temperature sensed by the second temperature sensor 700 reaches the first reference temperature in a state in which the transparent ice heater 430 is turned on and operates normally may be referred to as a second time (b).

When the transparent ice heater 430 is turned on, the ice making rate may be delayed, and thus the ice making time is lengthened. On the other hand, when the transparent ice heater 430 is turned off, the ice making rate is increased. Therefore, the second time (b) is longer than the first time (a).

The ice making time is different depending on whether the transparent ice heater 430 is turned on or off (or whether the transparent ice heater 430 operates normally). In this embodiment, by determining whether the ice making time has passed the set time, it is possible to determine whether the transparent ice heater 430 operates normally. In this case, the set time may be determined between the first time (a) and the second time (b).

For example, after determining the completion of the ice making, when it is determined that the ice making time has passed the set time (when the ice making time is greater than or equal to the set time), it may be determined that the transparent ice heater 430 operates normally.

On the other hand, after the completion of the ice making, when it is determined that the ice making time has not passed the set time (when the ice making time is less than the set time), it may be determined that the transparent ice heater 430 operates abnormally.

The case in which the transparent ice heater 430 operates abnormally may be a case in which the transparent ice heater 430 is maintained in an off state due to a disconnection of the transparent ice heater 430, or a case in which the transparent ice heater 430 does not operate with normal output in a turned-on state.

When it is determined in operation S9 that the ice making time has passed the set time, the controller 800 may determine that the transparent ice heater 430 operates normally, and the controller 800 may turn off the transparent ice heater 430 (S10).

In this case, a distance between the second temperature sensor 700 and each ice making cell 320*a* is different. Thus, in order to determine that the ice making is completed in all the ice making cells 320*a*, the controller 800 may perform the ice separation after a certain amount of time has passed from the time point when the transparent ice heater 430 is turned off or when the temperature sensed by the second temperature sensor 700 reaches a second reference temperature lower than the first reference temperature. Of course, when the transparent ice heater 430 is turned off, ice separation may be immediately started.

When the ice making is completed, the controller 800 operates one or more of the ice separation heater 290 and the transparent ice heater 430 (S11).

When at least one of the ice separation heater 290 or the transparent ice heater 430 is turned on, heat of the heaters 290 and 430 is transferred to at least one of the first tray 320 or the second tray 380 so that the ice may be separated from the surfaces (inner surfaces) of one or more of the first tray 320 and the second tray 380.

Also, the heat of the heaters 290 and 430 is transferred to the contact surface of the first tray 320 and the second tray 380, and thus, the lower surface 321*d* of the first tray 320 and the upper surface 381*a* of the second tray 380 may be in a state capable of being separated from each other.

When at least one of the ice separation heater 290 and the transparent ice heater 430 operate for a predetermined time, or when the temperature sensed by the second temperature sensor 700 is equal to or higher than an off reference temperature, the controller 800 is turned off the heaters 290 and 430, which are turned on (S11). Although not limited, the turn-off reference temperature may be set to above zero temperature.

The controller 800 operates the driver 480 to allow the second tray 380 to move in the forward direction (S12). As illustrated in FIG. 13, when the second tray 380 moves in the forward direction, the second tray 380 is spaced apart from the first tray 320.

The moving force of the second tray 380 is transmitted to the first pusher 260 by the pusher link 500. Then, the first pusher 260 descends along the guide slot 302, and the extension part 264 passes through the communication hole 321*e* to press the ice in the ice making cell 320*a*.

In this embodiment, ice may be separated from the first tray 320 before the extension part 264 presses the ice in the ice making process. That is, ice may be separated from the surface of the first tray 320 by the heater that is turned on. In this case, the ice may move together with the second tray 380 while the ice is supported by the second tray 380.

For another example, even when the heat of the heater is applied to the first tray 320, the ice may not be separated from the surface of the first tray 320.

Therefore, when the second tray 380 moves in the forward direction, there is possibility that the ice is separated from the second tray 380 in a state in which the ice contacts the first tray 320.

In this state, in the process of moving the second tray 380, the extension part 264 passing through the communication hole 320*e* may press the ice contacting the first tray 320, and thus, the ice may be separated from the tray 320. The ice separated from the first tray 320 may be supported by the second tray 380 again.

When the ice moves together with the second tray 380 while the ice is supported by the second tray 380, the ice may be separated from the second tray 380 by its own weight even if no external force is applied to the second tray 380.

While the second tray 380 moves, even if the ice does not fall from the second tray 380 by its own weight, when the second pusher 540 presses the second tray 380 as illustrated in FIG. 14, the ice may be separated from the second tray 380 to fall downward.

Specifically, as illustrated in FIG. 14, while the second tray 380 moves, the second tray 380 may contact the extension part 544 of the second pusher 540.

When the second tray 380 continuously moves in the forward direction, the extension part 544 may press the second tray 380 to deform the second tray 380. Thus, the pressing force of the extension part 544 may be transferred to the ice so that the ice is separated from the surface of the second tray 380. The ice separated from the surface of the second tray 380 may drop downward and be stored in the ice bin 600.

In this embodiment, as shown in FIG. 15, the position at which the second tray 380 is pressed by the second pusher 540 and deformed may be referred to as an ice separation position.

Whether the ice bin 600 is full may be detected while the second tray 380 moves from the ice making position to the ice separation position.

For example, the full ice detection lever 520 rotates together with the second tray 380, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 is not interfered with the ice while the full ice detection lever 520 rotates, it may be determined that the ice bin 600 is not in the full ice state.

After the ice is separated from the second tray 380, the controller 800 controls the driver 480 to allow the second tray 380 to move in the reverse direction (S13). Then, the second tray 380 moves from the ice separation position to the water supply position (51).

When the second tray 380 moves to the water supply position of FIG. 6, the controller 800 stops the driver 480.

When the second tray 380 is spaced apart from the extension part 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the extension part 264 is removed from the ice making cell 320*a*.

On the other hand, if it is determined in operation S9 that the ice making time has not passed the set time, the controller 800 sets the water supply amount to the second water supply amount (S21).

In this embodiment, the second water supply amount is smaller than the first water supply amount.

The controller 800 waits for ice separation until the elapsed time after the determination of the completion of the ice making reaches a waiting reference time (S22).

When the ice making is completed before the ice making time has passed the set time, the transparent ice heater 430 does not operate normally.

In this case, the temperature sensed by the second temperature sensor 700 reaches a first reference temperature before the water is phase-changed into ice as a whole.

For example, when the ice making cell 320*a* has a spherical shape, ice may be made in a spherical shape, but water may exist inside the ice. Ice containing such water is separated, and when a user uses the separated ice, it may cause emotional dissatisfaction.

Therefore, if it is determined that the transparent ice heater 430 operates abnormally, the controller 800 waits without performing the ice separation until the waiting time after the determination of the completion of ice making has passed the waiting reference time, so that the ice in the ice making cell 320*a* is completely frozen.

When the waiting time after the determination of the completion of ice making has passed the waiting reference time, the controller 800 may perform the ice separation (S23).

As another example, after the controller 800 determines that the ice making is completed, the controller 800 may wait for ice separation until the ice making time has passed the set time, and may perform ice separation when the ice making time has passed the set time.

Operation S23 of performing the ice separation may include operation S12 of operating the ice separation heater 290 and operation S12 of rotating the second tray 380 in a forward direction for ice separation.

Then, the controller 800 causes the second tray 380 to move to the water supply position (S24).

Water supply is started in a state in which the second tray 380 moves to the water supply position, as long as full ice is not detected in the ice separation process.

In this embodiment, after the abnormal operation of the transparent ice heater 430 is detected, water is supplied as much as the second water supply amount (S25).

For the water supply, the controller 800 may turn on the water supply valve 242, and when it is determined that an amount of water corresponding to the second water supply amount is supplied, the controller 800 may turn off the water supply valve 242.

For example, in the process of supplying water, when a pulse is outputted from a flow rate sensor (not shown) and the outputted pulse reaches a second reference pulse corresponding to the second water supply amount, it may be determined that an amount of water corresponding to the second water supply amount is supplied.

After the second tray 380 moves to the ice making position, ice making is started (S27).

In this embodiment, a communication hole 321*e* is disposed at the uppermost side 320*a* of the ice making cell 320*a*, and when water is supplied to the ice making cell 320*a* as much as the first water supply amount, the water in the ice making cell 320*a* is positioned lower than the communication hole 321*e*.

The height (or water level) of water in the ice making cell 320*a* when water is supplied to the ice making cell 320*a* as much as the first water supply amount may be determined considering the expansion force of water in the process in which water is phase-changed into ice.

If water is supplied to an extent higher than the communication hole 321*e*, the shape of the ice after the completion of the ice making becomes a spherical shape in which protrusions are formed on the upper side, so that ice separation is not smooth.

In addition, since the spherical ice includes the protrusion on the upper side after the completion of the ice separation, it may cause the emotional dissatisfaction of the user.

On the contrary, when water is supplied to a significantly lower height than the communication hole 321*e* (when water is supplied in an amount smaller than the first water supply), the ice becomes close to a hemispherical shape after the completion of the ice making. Thus, there is a disadvantage that the ice becomes opaque due to the high ice making rate.

Therefore, it is preferable that the height (or water level) of water when water is supplied to the ice making cell 320*a* as much as the first water supply amount is set to be lower than the communication hole 321*e* and close to the communication hole 321*e*.

When the transparent ice heater 430 operates normally in a state in which water is supplied as much as the first water supply amount, the heat is supplied to the lower side of the ice making cell 320*a*, and thus, ice starts to be made from the uppermost side of the ice making cell 320*a*. That is, ice starts to be made in a portion close to the communication hole 321*e* and grows downward.

The expansion force of water is applied not only to a portion of the made ice but also to the first tray 320 and the second tray 380 disposed lower than the communication hole 321*e*.

When each of the trays 320 and 380 is made of a flexible material, each of the trays 320 and 380 substantially absorbs most of the expansion force. Thus, the volume expands evenly throughout. Accordingly, after the ice making is completed, the ice becomes the same as or substantially similar to the ice making cell 320*a*.

On the other hand, when the transparent ice heater 430 does not operate normally in a state in which water is supplied as much as the first water supply amount, ice starts to freeze from the lower side of the ice making cell 320*a* because heat is not supplied to the lower side of the ice making cell 320*a* or less heat is supplied.

In this case, the expansion force of water is applied to the trays 320 and 380 and is applied toward the communication hole 321*e*.

Since the communication hole 321*e* is opened, water moves to a position higher than the communication hole 321*e* due to the volume expansion of water. In this state, the water may be phase-changed into ice. Even if water starts to freeze at the communication hole 321*e*, the expansion force applied toward the communication hole 321*e* is greater than when the transparent ice heater 430 operates normally. Thus, water may move to a position higher than the communication hole 321*e*.

When ice making is completed in this state, the shape of the ice after the completion of the ice making becomes a spherical shape with protrusions formed on the upper side. Thus, ice separation is not smooth. Since the spherical ice after the completion of the ice separation includes the protrusions at the upper side, it may cause emotional dissatisfaction of the user.

Therefore, in this embodiment, when the transparent ice heater 430 operates abnormally, water is supplied to the ice making cell 320*a* as much as a second water supply amount smaller than the first water supply amount, considering the expansion force of water. Although not limited, the second water supply amount may be set within a range of 85% to 95% of the first water supply amount, considering the expansion ratio of water. Even if the amount of water smaller than the first water supply amount is supplied to the ice making cell 320*a*, ice may be made in a shape identical to or similar to the spherical shape due to the expansion of water.

On the other hand, the controller 800 may determine whether ice making has been completed after the start of ice making (S28).

For example, when the temperature sensed by the second temperature sensor 700 reaches a first reference temperature, the controller 800 may determine that the ice making is completed.

If it is determined in operation S28 that the ice making has been completed, the controller 800 may determine whether the ice making time has passed a completion reference time (S29).

As the amount of water supplied to the ice making cell 320*a* is smaller and less heat is supplied from the transparent ice heater 430, the ice making rate is faster.

In this embodiment, in a state in which the transparent ice heater 430 does not operate normally, the water supply amount is also smaller than when the transparent ice heater 430 operates normally. Thus, the ice making rate more increases. That is, after the start of ice making, the time when the temperature sensed by the second temperature sensor 700 reaches the first reference temperature is short.

Accordingly, ice may be entirely made on the surface contacting the ice making cell 320*a*, but water may exist inside the ice.

Accordingly, when the temperature sensed by the second temperature sensor 700 reaches the first reference temperature after the start of ice making, ice separation may be immediately performed, and when the ice making time has passed the completion reference time, ice separation may be performed (S23).

That is, according to this embodiment, even after it is determined that the ice making is completed, the ice separation may be started after waiting for ice separation so that the water in the ice can completely freeze.

According to this embodiment, even if the transparent ice heater operates abnormally, it is possible to make ice in a spherical shape or a shape close to a sphere by adjusting the water supply amount.

In addition, there is an advantage in that it is possible to prevent ice from being separated in a state in which water exists in the ice after the completion of the ice making.

On the other hand, in this embodiment, since the transparent ice heater operates to make transparent ice during the ice making process, the ice making rate is slow compared to the case in which the transparent ice heater does not operate. In some cases, the user may want to quickly acquire ice, even if it is not transparent ice.

Accordingly, in this embodiment, a transparent ice mode for operating the transparent ice heater by using an input unit (not shown) or a button (not shown) provided in the ice maker may be selected, or a quick ice making mode in which the transparent ice heater does not operate may be selected.

The controller 800 may recognize the selection of one of the transparent ice mode and the quick ice making mode. If the transparent ice mode is selected, the first water supply amount may be set and water may be supplied to the ice making cell 320*a* as much as the first water supply amount.

The controller may control the transparent ice heater 430 to be turned on in at least partial section while the cold air supply part supplies cold air so that bubbles dissolved in the water within the ice making cell moves from a portion, at which the ice is made, toward the water that is in a liquid state to make transparent ice. In addition, the controller 800 may control one or more of the cooling power of the cold air supply part and the heating amount of the heater to vary according to the mass per unit height of water in the ice making cell. The variable control of the cooling power of the cold air supply part 900 or the control of the heating amount of the transparent ice heater 430 are the same as described above.

On the other hand, if the quick ice making mode is selected, the second water supply amount may be set and water may be supplied to the ice making cell 320*a* as much as the second water supply amount. In the quick ice making mode, the controller 800 may turn off the transparent ice heater 430.

Of course, when it is determined that the transparent ice heater 430 does not operate normally even if the transparent ice mode is selected, water may be supplied to the ice making cell 320*a* as much as the second water supply amount.

The invention claimed is:

1. A refrigerator comprising:
- a storage chamber;
- an ice maker;
- a cold air supply configured to supply cold air;
- a tray provided in the storage chamber and including a cell that forms a space in which a liquid introduced into the space is to phase-change into ice;
- a heater configured to provide heat to the tray; and
- a controller configured to:
  - start an ice making process after a liquid supply amount of the liquid is supplied to the cell,
  - operate the heater while the ice is being formed so that gas bubbles dissolved in the liquid within the cell move from a first portion of the space where the liquid has phase-changed into the ice to a second portion of the space where the liquid is in a fluid state,
  - determine whether the heater operates abnormally during the ice making process based on a temperature of the cell sensed by a temperature sensor, and
  - when the heater is determined to operate abnormally during the ice making process, reducing the liquid supply amount supplied to the cell during a subsequent ice making process,
  - wherein the controller is configured to determine that the heater operates abnormally during the ice making process, based on an elapsed time having elapsed from the start of the ice making process until the temperature of the cell sensed by the temperature sensor reaches a first reference temperature.

2. The refrigerator of claim 1, wherein, when the elapsed time is longer than a set time, the controller determines that the heater operates normally, and performs an ice separation process.

3. The refrigerator of claim 2, wherein, when the elapsed time is longer than the set time, the controller performs the ice separation process after waiting a waiting reference time from a time point when the temperature sensed by the temperature sensor reaches the first reference temperature.

4. The refrigerator of claim 1, wherein, when the elapsed time is less than a set time, the controller determines that the heater operates abnormally.

5. The refrigerator of claim 1, wherein the tray comprises a first tray to define a first portion of the cell and a second tray to define a second portion of the cell, the first portion and the second portion of the cell being configured to define the space of the cell to receive the liquid to be phase-changed to form ice, and the second tray contacts the first tray during the ice making process, and the second tray is spaced apart from the first tray in an ice separation process.

6. The refrigerator of claim 5, wherein the controller controls the cold air supply to supply cold air to the cell after the second tray moves to an ice making position and after the liquid supply amount of the liquid is supplied to the cell, after completion of the ice making process, the controller controls the second tray to move in a forward direction to an ice separation position so that the ice in the cell may be removed, and after completion of the ice separation process, the controller controls the second tray to move in a reverse direction to a liquid supply position.

7. The refrigerator of claim 5, wherein the controller controls the cold air supply to supply cold air to the cell after the second tray moves to an ice making position and after the liquid supply amount of the liquid is supplied to the cell, and the controller determines that the ice making process is completed when a sensed temperature in the cell reaches a first reference temperature.

8. The refrigerator of claim 7, wherein when the ice making process is determined to have been completed, the controller determines whether an ice making time has passed a completion reference time, and when the ice making time is determined to not have passed the completion reference time, the controller performs the ice separation process after the ice making time has passed the completion reference time.

9. The refrigerator of claim 1, wherein the controller is configured to control at least one of a cooling power of the cold air supply or a heating amount of the heater based on a mass per unit height of liquid in the cell.

* * * * *